US008905709B2

(12) United States Patent
Dziech et al.

(10) Patent No.: US 8,905,709 B2
(45) Date of Patent: Dec. 9, 2014

(54) LOW-DUCTILITY OPEN CHANNEL TURBINE SHROUD

(75) Inventors: Aaron Dziech, Cincinnati, OH (US); Joseph Albers, Fort Wright, KY (US); Christopher Ryan Johnson, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 1074 days.

(21) Appl. No.: 12/895,007

(22) Filed: Sep. 30, 2010

(65) Prior Publication Data

US 2012/0082540 A1 Apr. 5, 2012

(51) Int. Cl.

*F01D 25/24* (2006.01)
*F01D 11/00* (2006.01)
*F01D 11/12* (2006.01)

(52) U.S. Cl.

CPC ..... *F01D 11/125* (2013.01); *F05D 2240/55* (2013.01); *F01D 25/246* (2013.01); *F01D 11/005* (2013.01); *F05D 2240/11* (2013.01); *F05D 2260/20* (2013.01)
USPC ..... 415/173.1; 415/213.1

(58) Field of Classification Search

CPC ..... F01D 11/005; F01D 11/08; F01D 11/12; F01D 11/122; F01D 11/125; F01D 25/246; F05D 2240/11; F05D 2300/6033
USPC ..... 415/173.1, 200, 220, 213.1, 139
See application file for complete search history.

(56) References Cited

U.S. PATENT DOCUMENTS 5,074,748 A 12/1991 Hagle
5,154,577 A 10/1992 Kellock et al.
5,188,507 A 2/1993 Sweeney
5,655,876 A 8/1997 Rock et al.
6,059,525 A * 5/2000 Jiomacas et al. ..... 415/173.1
6,113,349 A * 9/2000 Bagepalli et al. ..... 415/135

(Continued)

FOREIGN PATENT DOCUMENTS

EP 1965030 A2 9/2008
GB 2481481 A 12/2011
JP 10331602 A 12/1998
WO 2009035487 A1 3/2009

OTHER PUBLICATIONS

Albers, et al.; U.S. Appl. No. 12/821,599, filed Jun. 23, 2010.
Marusko, et al.; U.S. Appl. No. 12/790,209, filed May 28, 2010.

(Continued)

*Primary Examiner* — Edward Look
*Assistant Examiner* — Jesse Prager
(74) *Attorney, Agent, or Firm* — General Electric Company; William Scott Andes

(57) ABSTRACT

A turbine shroud apparatus for a gas turbine engine includes: a plurality of arcuate shroud segments arranged as an annular shroud, each of the shroud segments comprising low-ductility material and having a cross-sectional shape defined by opposed forward and aft walls, and opposed inner and outer walls, the walls extending between opposed first and second end faces, wherein an open channel is formed through the outer wall of each shroud segment; an annular stationary structure surrounding the shroud segments; and a hanger received in the open channel of each shroud segment and mechanically coupled to the stationary structure, each of the hangers passing through the respective open channel and including an enlarged portion having greater cross-sectional area than the open channel, the enlarged portion engaging the outer wall of the respective shroud segment, so as to retain the shroud segment radially relative to the stationary structure.

5 Claims, 7 Drawing Sheets

(56) References Cited

U.S. PATENT DOCUMENTS

| | | | | |
|---|---|---|---|---|
| 6,290,459 | B1 | 9/2001 | Correia | |
| 6,315,519 | B1 * | 11/2001 | Bagepalli et al. | 415/135 |
| 6,340,285 | B1 | 1/2002 | Gonyou et al. | |
| 6,413,042 | B2 | 7/2002 | Correia | |
| 6,503,051 | B2 | 1/2003 | Predmore | |
| 6,752,592 | B2 * | 6/2004 | Mohammed-Fakir et al. | 415/139 |
| 7,011,493 | B2 * | 3/2006 | Marchi et al. | 415/116 |
| 7,556,475 | B2 * | 7/2009 | Roberts et al. | 415/173.1 |
| 7,722,317 | B2 * | 5/2010 | Schiavo et al. | 415/138 |
| 2003/0133790 | A1 | 7/2003 | Darkins et al. | |
| 2006/0078429 | A1 * | 4/2006 | Darkins et al. | 415/209.2 |
| 2008/0206046 | A1 | 8/2008 | Razzell et al. | |
| 2009/0060747 | A1 * | 3/2009 | Strock et al. | 416/241 B |
| 2011/0044803 | A1 | 2/2011 | Di Paola et al. | |

OTHER PUBLICATIONS

Shapiro, et al.; U.S. Appl. No. 12/696,566, filed Jan. 29, 2010.
GB Search Report dated Jan. 20, 2012 from corresponding Application No. GB1116369.8.

* cited by examiner

LOW-DUCTILITY OPEN CHANNEL TURBINE SHROUD

BACKGROUND OF THE INVENTION

This invention relates generally to gas turbine engines, and more particularly to apparatus for mounting shrouds made of a low-ductility material in the turbine sections of such engines.

A typical gas turbine engine includes one or more turbine rotors which extract energy from the primary gas flow. Each rotor comprises an annular array of blades or buckets carried by a rotating disk. The flowpath through the rotor is defined in part by a shroud, which is a stationary structure which circumscribes the tips of the blades or buckets. These components operate in an extremely high temperature environment, and must be cooled by air flow to ensure adequate service life. Typically, the air used for cooling is extracted (bled) from the compressor. Bleed air usage negatively impacts specific fuel consumption ("SFC") and should generally be minimized.

It has been proposed to replace metallic shroud structures with materials having better high-temperature capabilities, such as ceramic matrix composites (CMCs). These materials have unique mechanical properties that must be considered during design and application of an article such as a shroud segment. When compared with metallic materials, CMC materials have relatively low tensile ductility or low strain to failure, and a low coefficient of thermal expansion ("CTE").

One type of segmented CMC shroud incorporates a rectangular "box" design eliminating the conventional shroud hangers which are used to mount prior art metallic turbine shrouds. Rectangular box shrouds may require tight mechanical clamping against an outer casing structure. This can lead to problems if the frictional loading from clamping is larger than the axial load on the shroud, because the shroud needs to stay in contact with an axial stop to maintain proper sealing. For this to happen the shroud must be able to slide axially. This makes the clamped design potentially dependent on frictional forces which can be inconsistent.

Accordingly, there is a need for a CMC shroud mounting structure which does not rely on frictional clamping forces or concentrated fastener loads.

BRIEF SUMMARY OF THE INVENTION

This need is addressed by the present invention, which provides a turbine shroud having an open channel shape that is mounted to a stationary structure using a hanger received in the channel.

According to one aspect of the invention, a turbine shroud apparatus for a gas turbine engine includes: a plurality of arcuate shroud segments arranged as an annular shroud, each of the shroud segments comprising low-ductility material and having a cross-sectional shape defined by opposed forward and aft walls, and opposed inner and outer walls, the walls extending between opposed first and second end faces, wherein an open channel is formed through the outer wall of each shroud segment; an annular stationary structure surrounding the shroud segments; and a hanger received in the open channel of each shroud segment and mechanically coupled to the stationary structure, each of the hangers passing through the respective open channel and including an enlarged portion having greater cross-sectional area than the open channel, the enlarged portion engaging the outer wall of the respective shroud segment, so as to retain the shroud segment radially relative to the stationary structure.

According to another aspect of the invention, a turbine shroud apparatus for a gas turbine engine includes: a plurality of arcuate shroud segments arranged to form an annular shroud, each of the shroud segments comprising low-ductility material and having a cross-sectional shape defined by opposed forward and aft walls, and opposed inner and outer walls, the walls extending between opposed first and second end faces, wherein an open channel is formed through the outer wall of each shroud segment; an annular stationary structure surrounding the shroud segments; and a hanger received in the open channel of each shroud segment and mechanically coupled to the stationary structure, each of the hangers passing through the respective open channel and having a T-shaped cross section comprising a central portion extending through the open channel, flanked by at least one laterally-extending rail which engages the outer wall of the respective shroud segment, so as to retain the shroud segment in a radial direction relative to the stationary structure.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
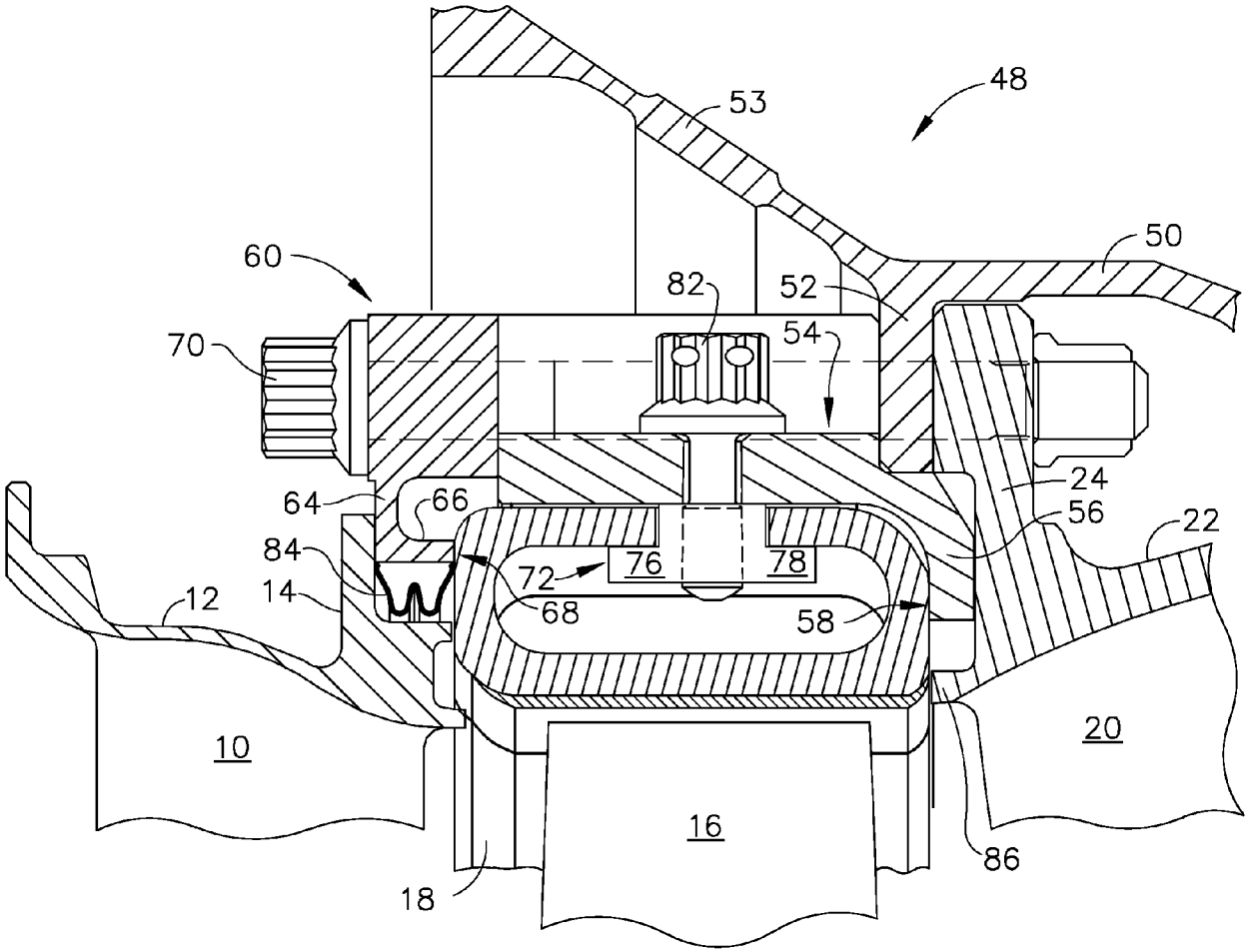
FIG. 1 is a schematic cross-sectional view of a portion of a turbine section of a gas turbine engine, incorporating a turbine shroud and mounting apparatus constructed in accordance with an aspect of the present invention.

Referring to the drawings wherein identical reference numerals denote the same elements throughout the various views, FIG. 1 depicts a small portion of a gas generator turbine (also referred to as a high pressure turbine), which is part of a gas turbine engine of a known type. The function of the gas generator turbine is to extract energy from high-temperature, pressurized combustion gases from an upstream combustor (not shown) and to convert the energy to mechanical work, in a known manner. The gas generator turbine drives an upstream compressor (not shown) through a shaft so as to supply pressurized air to the combustor.

In the illustrated example, the engine is a turboshaft engine and a work turbine would be located downstream of the gas generator turbine and coupled to a shaft driving a gearbox, propeller, or other external load. However, the principles described herein are equally applicable to turbojet and turbofan engines, as well as turbine engines used for other vehicles or in stationary applications.

The gas generator turbine includes a first stage nozzle which comprises a plurality of circumferentially spaced airfoil-shaped hollow vanes 10 that are circumscribed by an arcuate, segmented outer band 12. An annular flange 14 extends radially outward at the aft end of the outer band 12. The vanes 10 are configured so as to optimally direct the combustion gases to a downstream first stage rotor.

The first-stage rotor includes a disk (not shown) that rotates about a centerline axis of the engine and carries an array of airfoil-shaped turbine blades 16. A shroud comprising a plurality of arcuate shroud segments 18 is arranged so as to closely surround the turbine blades 10 and thereby define the outer radial flowpath boundary for the hot gas stream flowing through the first stage rotor.

A second stage nozzle is positioned downstream of the first stage rotor. It comprises a plurality of circumferentially spaced airfoil-shaped hollow vanes 20 that are circumscribed by an arcuate, segmented outer band 22. An annular flange 24 extends radially outward at the forward end of the outer band 22.

Figure 2:
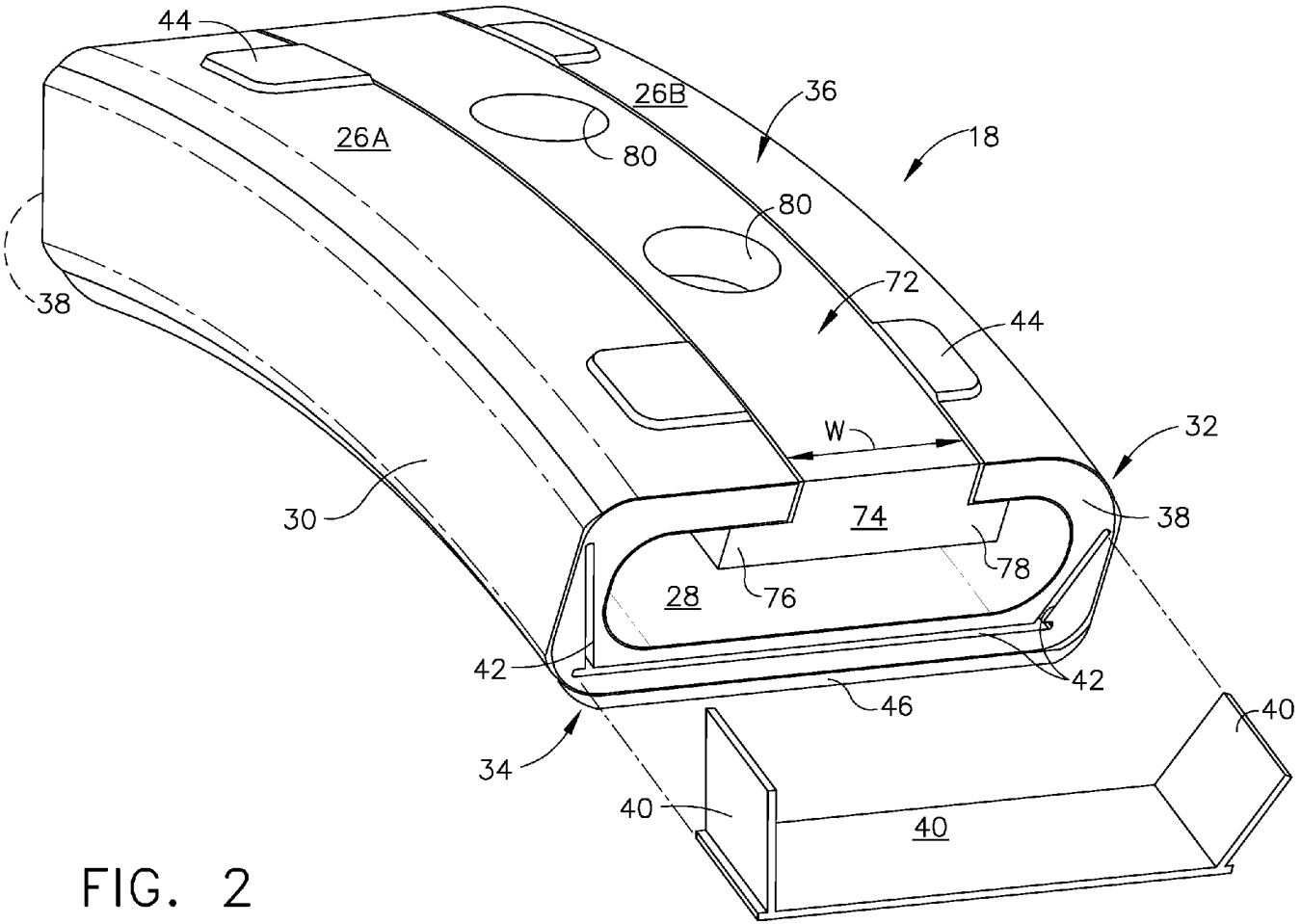
FIG. 2 is a perspective view of a turbine shroud segment shown in FIG. 1.

As seen in FIG. 2, each shroud segment 18 has a cross-sectional shape which is generally rectangular, comprising spaced-apart forward and aft outer walls 26A and 26B which lie opposite to an inner wall 28, and forward and aft walls 30 and 32. In the illustrated example radiused transitions are provided between the walls, but sharp or square-edged transitions may be used as well. An open channel is defined in the space between the forward and aft outer walls 26A and 26B. The shroud segment 18 has a radially inner flowpath surface 34 and a radially outer back surface 36.

The shroud segments 18 include opposed end faces 38 (also commonly referred to as "slash" faces). The end faces 38 may lie in a plane parallel to the centerline axis of the engine, referred to as a "radial plane", or then may be oriented so that they are at an acute angle to such a radial plane. When assembled and mounted as described above, end gaps are present between the end faces 38 of adjacent shroud segments 18. One or more seals 40 may be provided at the end faces 38. Similar seals are generally known as "spline seals" and take the form of thin strips of metal or other suitable material which are inserted in slots 42 in the end faces 38. The spline seals 40 span the gaps between shroud segments 18.

The shroud segment 18 may include a locating feature which engages a mounting component in order to provide an anti-rotation function. In the illustrated example ribs 44 protrude from the outer walls 26A and 26B. Nonlimiting examples of alternative locating features include a recess or hole formed in or through the outer walls 26A and 26B, or more notches formed in one or both of the end faces 38.

The shroud segments 18 are constructed from a ceramic matrix composite (CMC) material of a known type. Generally, commercially available CMC materials include a ceramic type fiber for example SiC, forms of which are coated with a compliant material such as Boron Nitride (BN). The fibers are carried in a ceramic type matrix, one form of which is Silicon Carbide (SiC). Typically, CMC type materials have a room temperature tensile ductility of no greater than about 1%, herein used to define and mean a low tensile ductility material. Generally CMC type materials have a room temperature tensile ductility in the range of about 0.4 to about 0.7%. This is compared with metals having a room temperature tensile ductility of at least about 5%, for example in the range of about 5 to about 15%. The shroud segments 18 could also be constructed from other low-ductility, high-temperature-capable materials.

The flowpath surface 34 of the shroud segment 18 incorporates a protective layer 46 (for example, it may be an abradable or rub-tolerant material of a known type suitable for use with CMC materials, or an environmentally-resistant or anti-moisture coating). This layer is sometimes referred to as a "rub coat". In the illustrated example, the protective layer 46 is about 0.051 mm (0.020 in.) to about 0.76 mm (0.030 in.) thick.

Referring back to FIG. 1, the shroud segments 18 are mounted to a stationary engine structure constructed from suitable metallic alloys, e.g. nickel- or cobalt-based "superalloys". In this example the stationary structure is an annular turbine stator assembly 48 having (when viewed in cross-section) an axial leg 50, a radial leg 52, and an arm 53 extending axially forward and obliquely outward from the junction of the axial and radial legs 50 and 52.

An aft spacer 54 abuts against the forward face of the radial leg 52. The aft spacer 54 may be continuous or segmented. Its shape is generally cylindrical and it includes a flange 56 extending radially inward at its aft end. This flange 56 defines an aft bearing surface 58. One or more fastener holes pass through the aft spacer 54.

A forward spacer 60, which may be continuous or segmented, abuts the forward end of the aft spacer 54. The forward spacer 60 includes a hook protruding radially inward with radial and axial legs 64 and 66, respectively. The hook defines a forward bearing surface 68.

The turbine stator assembly 48, flange 24 of the second stage nozzle, aft spacer 54, and forward spacer 60 are all mechanically assembled together, for example using the illustrated bolt and nut combination 70 or other suitable fasteners.

An array of arcuate hangers 72 are received in the open channel between the forward and aft outer walls 26A and 26B. In cross-section each hanger 72 appears as a "T" shape with a central portion 74 (see FIG. 2) flanked by two rails 76 and 78. Appropriate fastener holes 80 (see FIG. 2) are formed through the central portion 74. The width "W" of the central portion 74 is selected to as to provide a close fit between the forward and aft outer walls 26A and 26B, while still permitting sufficient clearance to slide the hangers 72 into the shroud segments 18.

As seen in FIG. 1, the hanger 72 is coupled to the aft spacer 54 with mechanical fasteners such as the illustrated bolts 82. The rails 76 and 78 bear against the forward and aft outer walls 26A and 26B, respectively, securing the shroud segments 18 to the aft spacer 54 in the radial direction. The dimensions of the hanger 72 may be selected so as to provide a radial clearance between the aft spacer 54 and the shroud segments 18. This configuration provides a substantially increased bearing surface as compared to using individual bolts passing directly through the shroud segments 18.

In the illustrated example, the material, sizing, and shapes of the forward and aft bearing surfaces 68 and 58 are selected so as to present substantially rigid stops against axial movement of the shroud segments 18 beyond predetermined limits, and may provide a predetermined compressive axial clamping load to the shroud segments 18 in a fore-and-aft direction. This structure is optional and if desired, all axial positioning of the shroud segments 18 may be accomplished by the interaction between the hangers 72 and the forward and aft outer walls 26A and 26B.

Appropriate means are provided for preventing leakage from the combustion flowpath to the space outboard of the shroud segments 18. For example, an annular spring seal 84 or "W" seal of known type may be provided between the flange 14 of the first stage outer band 12 and the shroud segments 18. The aft end of the shroud segments bear against a sealing rail 86 of the second stage vanes 20. Other means to prevent leakage and provide seal could be provided.

The stationary structure may include locating features (not shown), such as ribs, pins, or notches that engage the corresponding locating features of the shroud segments 18 in order to provide an anti-rotation function.

Figure 3:
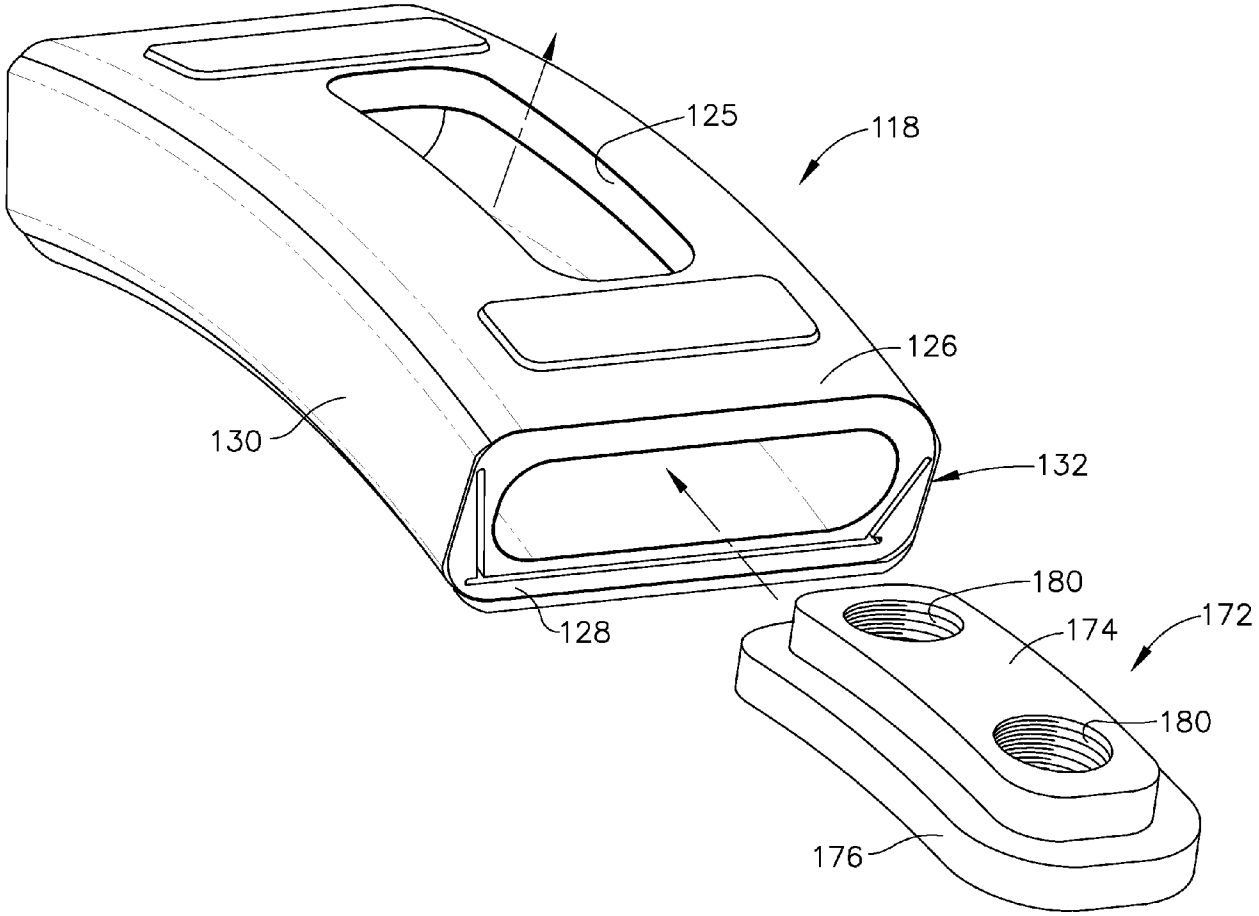
FIG. 3 is an exploded, perspective view of an alternative turbine shroud segment and hanger suitable for use with the mounting apparatus shown in FIG. 1.
Figure 4:
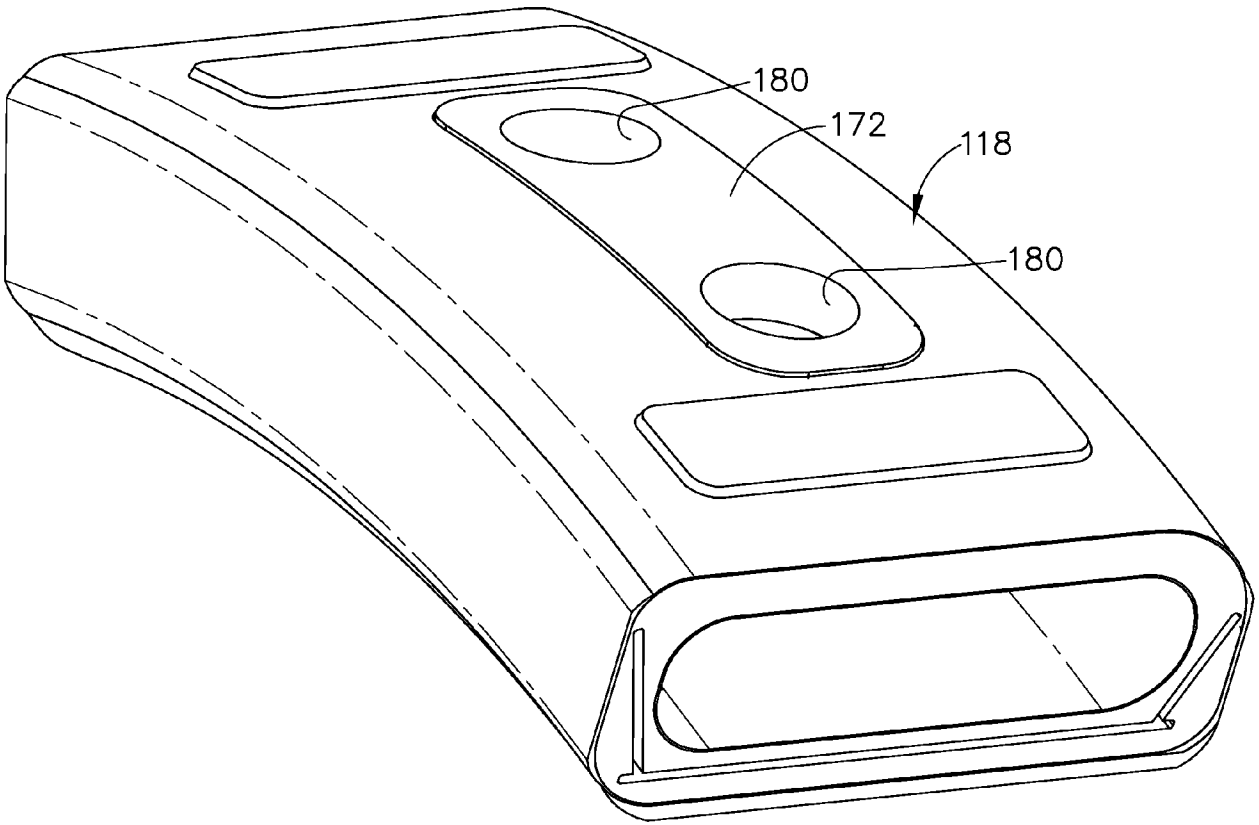
FIG. 4 is a perspective view of a turbine shroud segment shown in FIG. 3, assembled with a hanger.

FIGS. 3 and 4 illustrate an alternative shroud segment 118 for use with the stationary structure shown in FIG. 1. The shroud segment 118 is similar to the shroud segment 18 described above and is made from a low-ductility, high-temperature-capable material. It has a cross-sectional shape which is generally rectangular, comprising spaced-apart outer and inner walls 126 and 128, and forward and aft walls 130 and 132. An open channel 125 is formed through the outer wall 126. The circumferential length of the channel 125 is less than the total circumferential extent of the shroud segment 118.

An arcuate hanger 172 is provided similar to the hanger 72 described above, having a "T" shaped cross-section with a central portion 174 flanked by a continuous peripheral rail 176. The dimensions of the central portion 174 and the overall radial thickness of the hanger 172 are selected to as to provide a close fit in the channel 125, while still permitting sufficient clearance to slide the hangers 172 into the shroud segments 118. Appropriate fastener holes 180 are formed through the central portion 174. FIG. 4 illustrates the hanger 172 inserted into the channel 125. The shroud segment 118 and the hanger 172 are mounted to the aft spacer 54 as described above. In this configuration, the hanger 172 may serve to locate the shroud segments 118 tangentially (i.e. to perform an anti-rotation function) as well as locating the shroud segment 118 axially.

Figure 5:
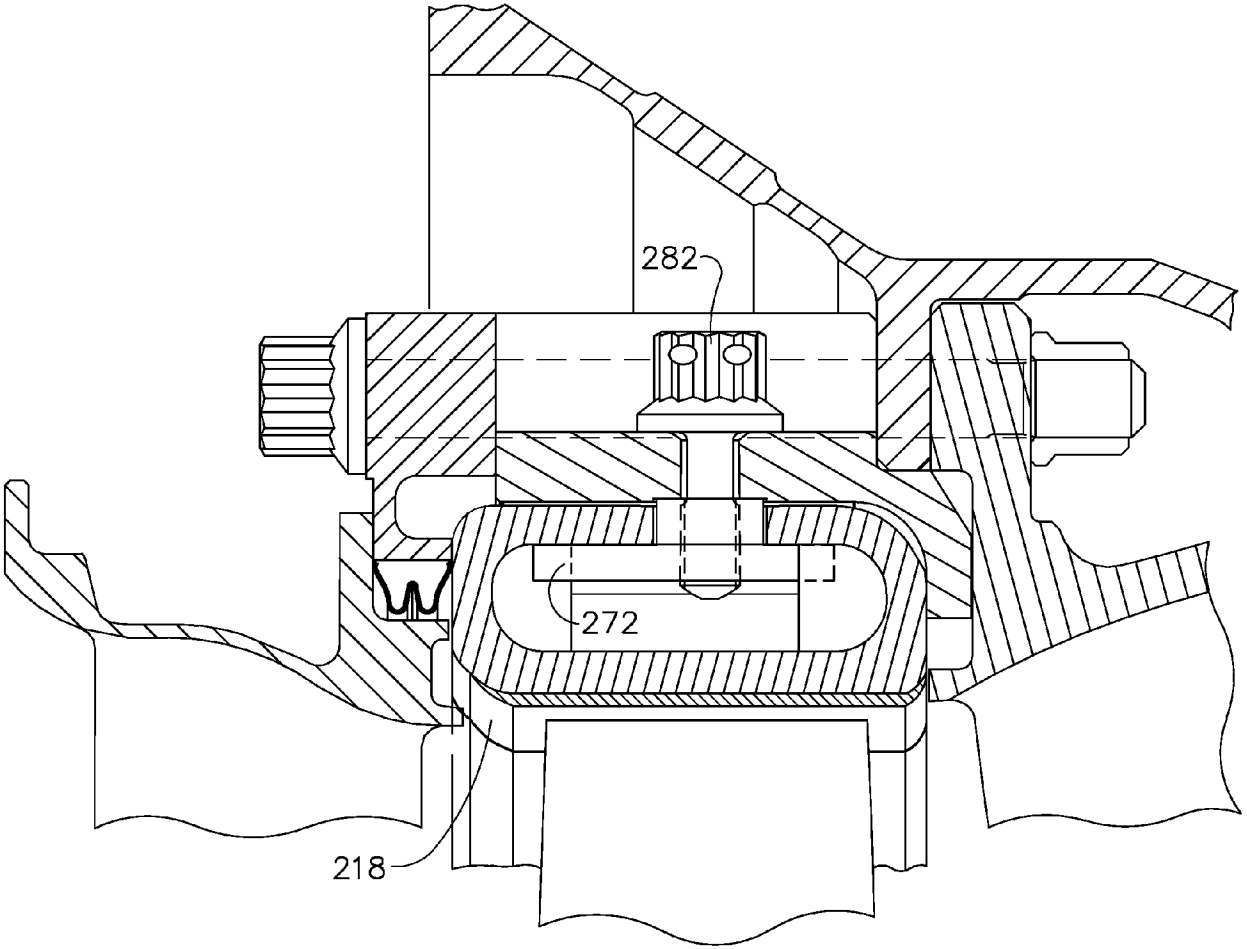
FIG. 5 is a schematic cross-sectional view of a portion of a turbine section of a gas turbine engine, incorporating an alternative turbine shroud and mounting apparatus constructed in accordance with an aspect of the present invention.
Figure 6:
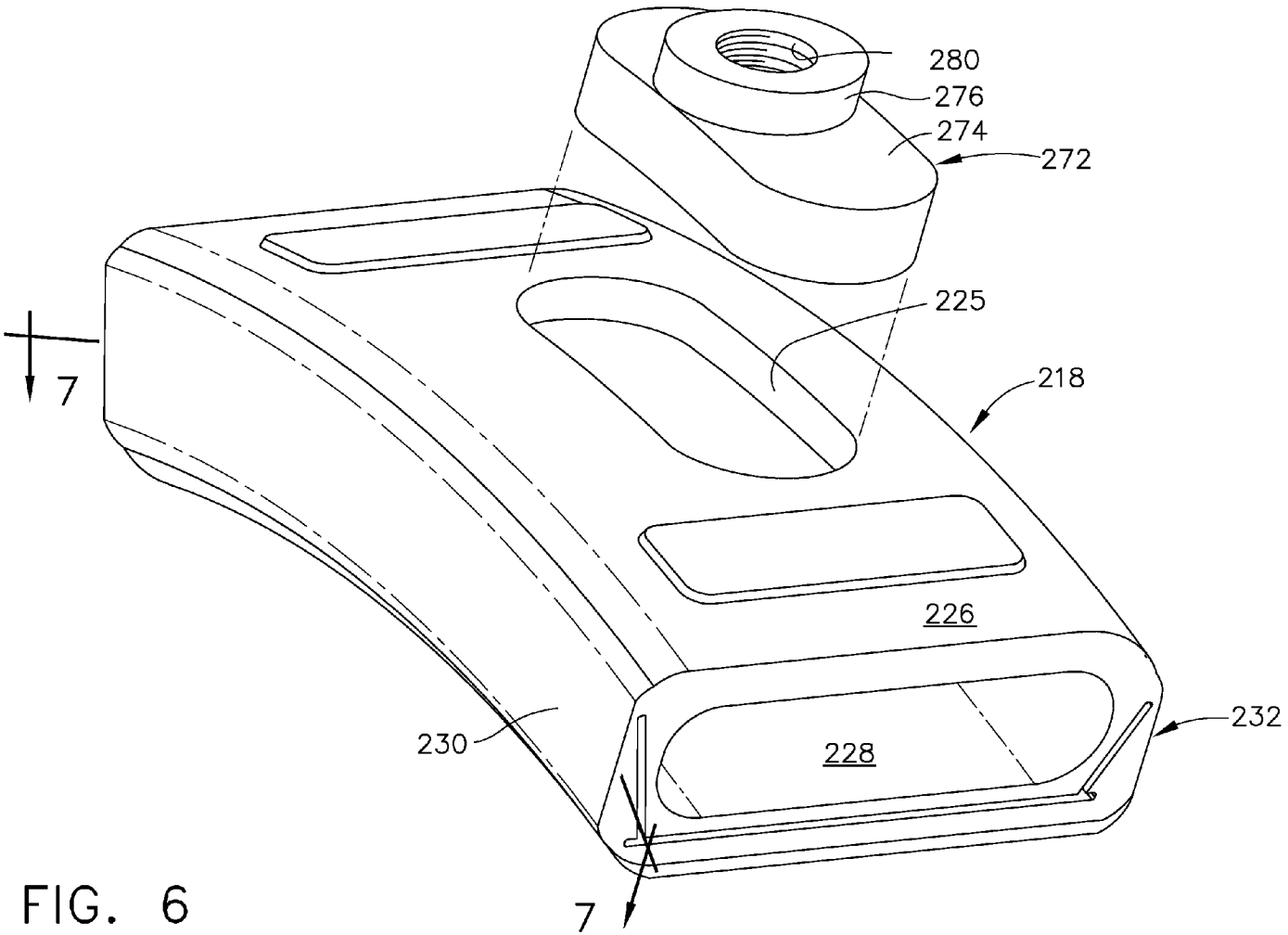
FIG. 6 is an exploded, perspective view of a turbine shroud segment and hanger shown in FIG. 5.
Figure 7:
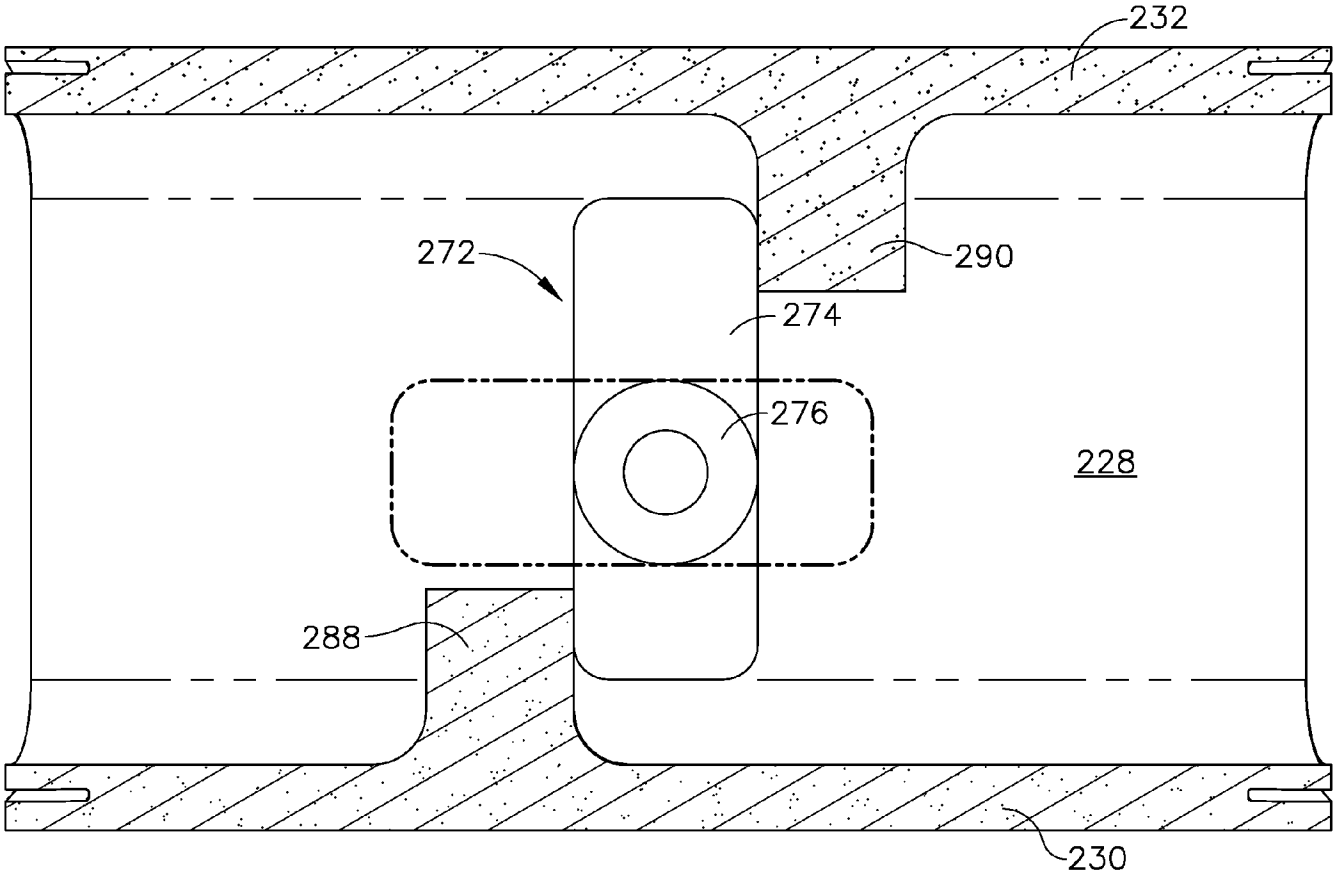
FIG. 7 is a cross-sectional view taken along lines 7-7 of FIG. 6.

FIGS. 5-7 illustrate an alternative shroud mounting configuration including an annular array of shroud segments 218 and associated hangers 272 coupled to a stationary turbine structure.

The shroud segments 218 are constructed from a ceramic matrix composite (CMC) material of a known type or another low-ductility, high-temperature-capable material. They are substantially similar in overall design to the shroud segments 18 described above.

Each shroud segment 218 has a hollow cross-sectional shape defined by opposed inner and outer walls 228 and 226, and forward and aft walls 230 and 232. The shroud segments 218 include opposed end faces as described above, and may include locating features as described above. An open channel 225 is formed through the outer wall 226. The circumferential length of the channel 225 is less than the total circumferential extent of the shroud segment 218. As seen in FIG. 7, the interior of the shroud segment 218 includes offset stub walls 288 and 290 extending axially inward from the forward and aft walls 230 and 232, respectively.

The hangers 272 are similar to the hangers 72 described above. Each hanger 272 has a body 274 with a protruding cylindrical boss 276. The dimensions of the body 274 are selected to as to provide a close fit in the channel 225, while still permitting sufficient clearance to slide the hangers 272 into the shroud segments 218. The height of the boss 276 above the outboard surface of the body 274 is selected to be approximately equal to, or slightly greater than, the thickness of the outer wall 226 of the shroud segment 218, depending upon how much radial clearance is desired for a particular application. Appropriate fastener holes 280 are formed through the boss 276.

The shroud segments 218 are mounted by first aligning a hanger 272 with the channel 225 and inserting it therethrough, so the distal end of the boss 276 is approximately flush with the outboard surface of the shroud segment 218. This orientation is shown in the dot-dashed line in FIG. 7. The hanger 272 is then rotated approximately 90 degrees until further rotation is stopped by the stub walls 288 and 290. A suitable mechanical fastener, such as the bolt 282 shown in FIG. 5, may then be threaded into the fastener hole 280 to draw the hanger 272 (and thus the shroud segment 218) towards the surrounding component. Depending on the specific installation technique used, the rotation of the hanger 272 may occur naturally as the bolt 282 is initially tightened.

The shroud segment configuration described herein has several advantages over rectangular box shrouds. It eliminates sliding friction problems, reduces stress concentration factors and reduces mounting issues due to thermal expansion differences associated with the installation of rectangular box shrouds with metal supporting structure. It may also enable the elimination of a high-temperature bolt. The hanger 72 eliminates the necessity to hard clamp the shroud segments 18, thus reducing wear on the metal parts while keeping the shroud segments 18 from being over-constrained. Clamping of the shroud segment 18 in a pinching manner eliminates the need to slide axially. This eliminates the requirement to load the shroud axially with a magnitude necessary to overcome the high friction between CMC and metal and the wear that this motion induces.

The foregoing has described a turbine shroud structure and mounting apparatus for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A turbine shroud apparatus for a gas turbine engine, comprising:

a plurality of arcuate shroud segments arranged to form an annular shroud, each of the shroud segments comprising low-ductility material and having a cross-sectional shape defined by opposed forward and aft walls, and opposed inner and outer walls, the walls extending between opposed first and second end faces, wherein an open channel is formed through the outer wall of each shroud segment, wherein the open channel is shorter than the shroud segment in a circumferential direction, and the shroud segment includes offset stub walls extending radially inward from each of the forward and aft walls;

an annular stationary structure surrounding the shroud segments; and a hanger received in the open channel of each shroud segment, each of the hangers passing through the respective open channel and having a T-shaped cross section comprising a central portion extending through the open channel and contacting the annular stationary structure, the central portion being flanked by at least one laterally-extending rail which engages the outer wall of the respective shroud segment, so as to retain the shroud segment in a radial direction relative to the stationary structure, wherein the central portion of each hanger is mechanically coupled to the stationary structure by a mechanical fastener.

2. The apparatus of claim 1 wherein the stationary structure includes substantially rigid annular forward and aft bearing surfaces which bear against the forward and aft walls, respectively, of each shroud segment, so as to restrain the shroud segments from axial movement and radially inward movement relative to the stationary structure.

3. The apparatus of claim 1 wherein the stationary structure comprises:

an annular turbine stator;

an annular aft spacer including a flange extending radially inward at its aft end which defines an axially-facing aft bearing surface; and a forward spacer including a hook protruding radially inward which defines an axially-facing forward bearing surface.

4. The apparatus of claim 1 wherein the hanger includes:

an elongated body sized to fit through the open channel; and a boss protruding radially outward from the body, the boss having a height from the body approximately equal to a thickness of the outer wall.

5. The apparatus of claim 1 wherein each of the shroud segments comprises a ceramic matrix composite material.

* * * * *